US006702168B2

(12) United States Patent
Panosian

(10) Patent No.: US 6,702,168 B2
(45) Date of Patent: Mar. 9, 2004

(54) MODULAR PERSONAL CONTAINER

(75) Inventor: Michael H. Panosian, Glendale, CA (US)

(73) Assignee: Olympia Group, Inc., City of Industry, CA (US)

( * ) Notice: Subject to any disclaimer, the term of this patent is extended or adjusted under 35 U.S.C. 154(b) by 0 days.

(21) Appl. No.: 09/975,687

(22) Filed: Oct. 11, 2001

(65) Prior Publication Data

US 2003/0071099 A1 Apr. 17, 2003

(51) Int. Cl.[7] ..... A45C 1/04

(52) U.S. Cl. ..... 224/583; 220/694; 224/682; 224/683; 224/684

(58) Field of Search ..... 224/683, 682, 224/684, 680, 904, 583, 240, 584, 681, 161, 576; 206/373, 372, 349; 220/915.2, 694; 150/159

(56) References Cited

U.S. PATENT DOCUMENTS 4,598,803 A * 7/1986 Ghiassi ..... 190/102
4,746,044 A * 5/1988 Arvizu et al. ..... 224/155
4,765,472 A * 8/1988 Dent ..... 206/373
5,205,448 A * 4/1993 Kester et al. ..... 224/575
5,409,291 A * 4/1995 Lamb et al. ..... 224/155
5,772,066 A * 6/1998 Reynolds ..... 220/23.83
5,833,095 A 11/1998 Russell et al. ..... 224/576
6,085,902 A * 7/2000 Fang ..... 206/373
D446,617 S 8/2001 Urbanski ..... D32/53
6,315,310 B1 * 11/2001 Hurt ..... 206/373

* cited by examiner

*Primary Examiner*—Gregory Vidovich
*Assistant Examiner*—Maerena W. Brevard
(74) *Attorney, Agent, or Firm*—Stallman & Pollock LLP

(57) ABSTRACT

A modular personal container has a stiff container shaped to receive and support a soft container in the preferred configuration of a tool belt. Both containers provide correspondingly shaped fixating and positioning features. The fixating features interlock the soft container with the stiff container. The interlocked soft container is then lowered down onto the stiff container until positioning edges of the soft container contact positioning shoulders of the stiff container. Pockets laterally protruding from the stiff container provide the positioning shoulders. A shoulder belt may be simultaneously snapped on lugs individually attached on both containers. A loose hip belt of the assembled soft container is packed away in a belt pocket recessed from a smooth rear side of the stiff container. The stiff container has a handgrip and a top lid for accessing a storage volume of the stiff container with or without the soft container being attached.

12 Claims, 5 Drawing Sheets

MODULAR PERSONAL CONTAINER

BACKGROUND OF THE INVENTION

1. Field of the Invention

This invention relates to a modular personal container that includes a soft container and a correspondingly shaped stiff container. More particularly, the invention relates to a personal container having a soft container that is configured to be ergonomically and self-supportedly carried at a person's waist area and having the stiff container configured to receive and support the soft container when it is not carried by the person.

2. Discussion of the Related Art

Personal containers are available in various configurations adapted to suit specific tasks. For example, a prior art personal container may be configured to be carried at a person's waist area. Such containers are commonly known as tool belts that may have enlarged bag and/or pocked like structures integrated into a belt. The enlarged structures may be shaped to receive, organize and/or store, for example, hand tools or other items. Tool belts are usually shaped to be worn around the waist area with the enlarged structure hanging down and being supported by the person's hip such that the stored items can be ergonomically accessed on an ongoing base.

Tool belts are commonly made of soft material in order to provide a clinging fit and to adjust to a hip shape and hip movements of the person wearing the tool belt. Also, in order to provide easy access to the stored items, the storing features are preferably designed with openings against the direction of gravity for a sufficiently upright wearing position of the person.

Unfortunately, once a tool belt is taken off, it does not maintain it's shape, which makes it eventually difficult to put it away or store the tool belt while it is not worn. The softer a tool belt is configured, the more wearing comfort it provides but the less feasible it becomes to be stored at a locations other then a persons waist/hip area. Therefore, there exists a need for a device that has a stiff shape corresponding to the shape of a soft personal container such that the soft personal container can be properly stored while not used. The present invention addresses this need.

Personal containers may also be simultaneously used for diverse transportation and storage tasks. Many practical endeavors require a significant load being carried over a longer distance to an activity site. Once the activity site is reached, only a part of the carried load has to remain immediately accessible, whereas a remaining portion of the carried load only needs to be accessed occasionally. An immediately accessible container may be a soft container as described in the above. In order to provide occasionally accessed storage space, a second stiff container is commonly carried to the activity site.

Since tool belts commonly hamper walking, a person may tend to carry the tool belt and the stiff container simultaneously, one in each hand, which reduces the person's agility. During unsafe walks to activity site like, for example, a construction site, it may be necessary to have at least one hand free. Therefore, there exists a need for a soft container and a correspondingly shaped stiff container such that they can be assembled and carried along one body side as a single unit. The present invention addresses this need.

SUMMARY OF THE INVENTION

In accordance with the present invention, a modular personal container provides a soft container preferably configured to be ergonomically worn at a hip area of a person. The ergonomic configuration includes a softness and a tailored contour that provide a clinging fit to the person's hip area. The modular personal container further provides a stiff container that is shaped to receive and support the soft container on the circumference of the stiff container. The stiff container provides fixating features and positioning features that correspond to features of the soft container such that the soft container can be easily lowered down and fixated on the stiff container. Fixating features may include catch and/or snap fittings correspondingly placed on both containers. This allows the soft container to be interlocked with a simple two-hand motion. Once the two containers are interlocked, the soft container may be further lowered down onto the stiff container until the positioning features contact correspondingly tailored edges of the soft container. Once the soft container is fixated onto the stiff container a shoulder belt may be snapped on lugs of both containers.

The stiff container may have a circumference that is significantly smaller than a person's waist. Consequently, a remaining hip belt of the soft container may be folded into a correspondingly shaped belt pocket after the soft container has been attached to the stiff container.

A central storage volume of the stiff container remains accessible via a top lid. The soft container has an upper tailor line that is shaped such that a locking feature of the top lid, for example a zip, remains accessible while the soft container is fixated on the stiff container. The stiff container may further have a handgrip. At the handgrip, the stiff container may be carried alone or together with the eventually attached soft container. The shoulder belt may also be independently used to carry only one of the two containers.

DETAILED DESCRIPTION OF THE INVENTION

Figure 1:
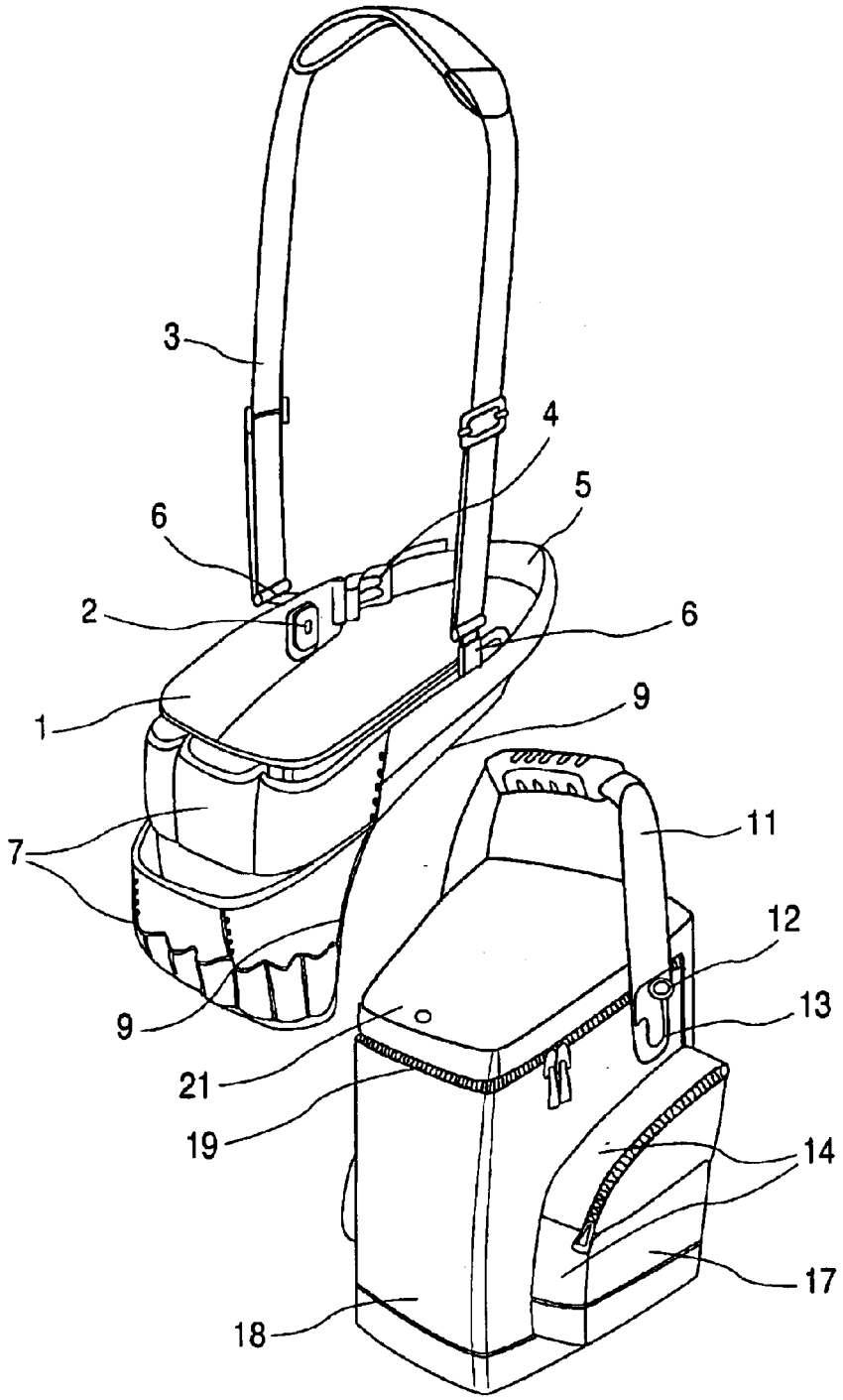
FIG. 1 shows a three dimensional view of an exemplary soft container in assembly approach to an exemplary stiff container.

Referring to the drawings in general and FIG. 1 in particular, a soft container 1 is shown approaching a stiff container 18 in assembly direction 26. It is noted that the scope of the invention is not limited to a particular procedure by which the soft container 1 and the stiff container 18 are assembled. Moreover, the assembly direction 26 is solely presented for the purpose of general understanding without any claim of the accuracy thereof. In the context of the present invention, the term "soft container" applies to any container having a softness to provide a clinging fit to a person wearing the soft container 1. In the context of the present invention, the term "stiff container" applies to any container having a stiffness that is at a level such that the stiff container 18 maintains its shape while standing free.

The soft container 1 includes a pliant body 20 from which two pliant flaps 22 extend. At least at one end of the pliant flaps 22 extends a belt 5, which can be closed with the belt loop 4 attached at the end of the other pliant flap 22. It is clear to one skilled in the art that many varying configurations of a belt 5 and a belt loop 4 may be utilized within the scope of the invention.

Figure 3:
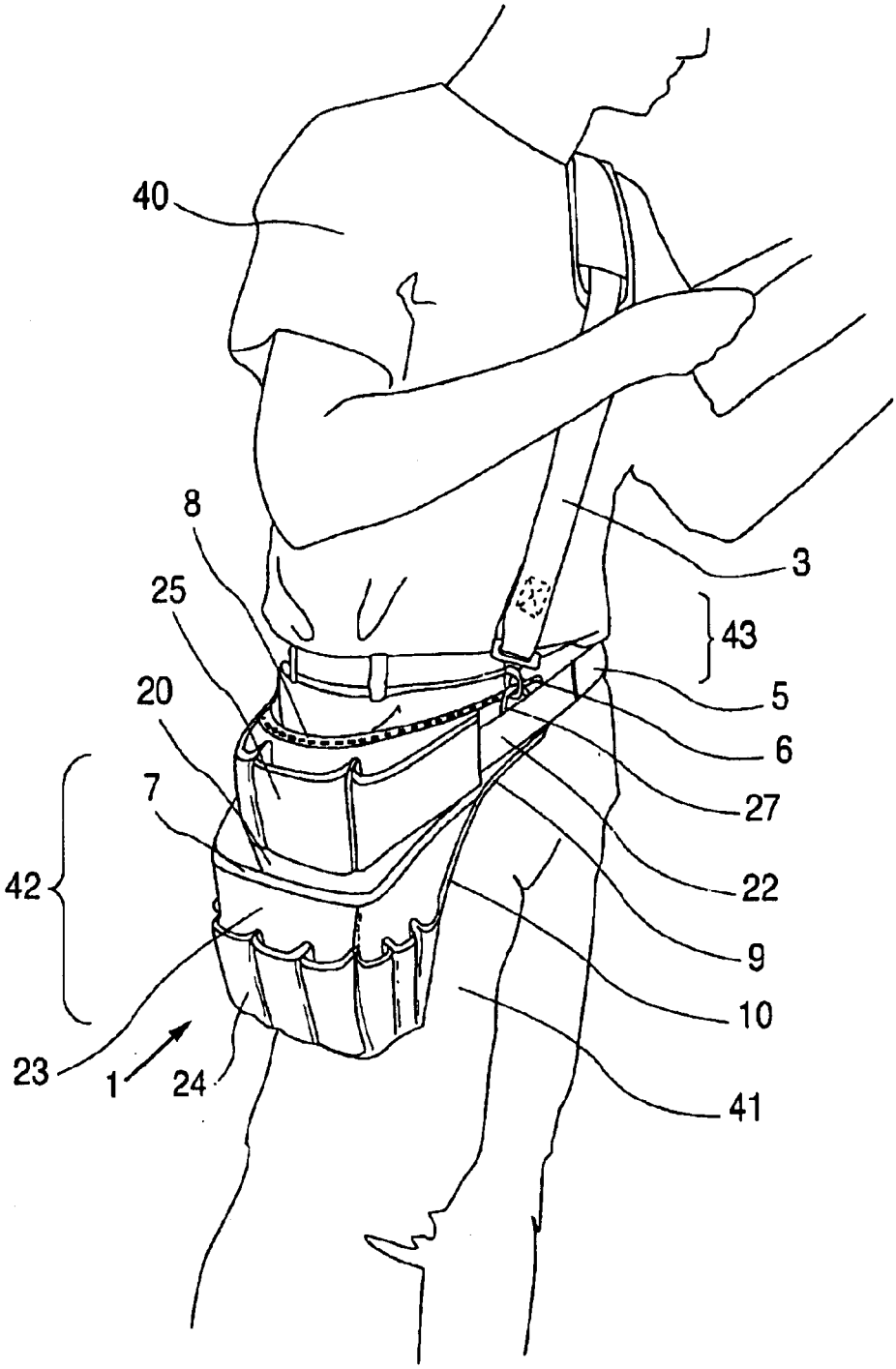
FIG. 3 shows a three dimensional view of the soft container worn by a person.

Referring to FIG. 3, the soft container 1 is preferably tailored and/or shaped to provide a clinging fit to a hip area 42 of a person 40 wearing the soft container 1. The soft container 1 may be worn by having the belt 5 entangle the opposing hip 43 such that the pliant body 20 clings to the hip area 42 down along the thigh 41. Additional support may be provided by a shoulder strap 3 that may be snapped on primary lugs 27 of the soft container 1. One primary lug 27 is attached on each of the pliant flaps 22. It is noted that in FIGS. 1 and 3 only one of the primary lugs 27 is visible. It is clear to one skilled in the art from studying FIGS. 1 and 3 that the invisible primary lug 27 may be positioned at any location suitable for attaching the shoulder strap 3. The shoulder strap 3 may have on each end a strap buckle 6 for attaching the shoulder strap 3.

The soft container 1 may have a number of pockets that are ergonomically arranged to store and/or stack various items like, for example, hand tools and the like. In the preferred embodiment, the soft container 1 has a top pocket line 25, a medium pocket line 23, and a bottom pocket line 24. The pocket lines 23, 24, 25 have their opening essentially against the direction of gravity to prevent items from falling out of the pockets while the soft container 1 is worn by the person 40.

The outside contours of the soft container 1 are defined by the upper tailored edge 8, the flap edge 9 and the bag edge 10. Both the upper edge 8 and the flap edge 9 start at the outer ends of the pliant flaps 22 with an initial direction that is almost parallel with the direction of the belt 5. The upper edge 8 forms a smooth arc between the two ends of the pliant flaps 22. The flap edge 9 curves into the bag edge 10, which forms together with the flap edge 9 an obtuse angle. Due to the shapes of the edges 8, 9 and 10, the soft container 1 may be made from soft material without wrinkling under load.

The pocket edge 7 continues approximately in the direction of the flap edge 9. The pocket edge 7 defines the opening of the medium pocket line 23. The pocket edge 7 has also a smooth curvature to prevent wrinkling of the medium pocket line 23, which has a continuous aperture along the pliant body 20. Regardless of the exemplary illustrations of the pocket lines 23, 24, 25, it is clear that the scope of the invention may include various configurations of pockets as they are well known for tool belts and the like.

Referring back to FIG. 1, the pliant flaps 22 may additionally provide at their inside male catches 2. It is noted that only the rear male catch 2 is visible in FIG. 1. A second male catch 2 has to be considered on the corresponding location of the opposing pliant flap 22. The male catches 2 are flat and chubby devices that protrude only slightly away from the inner surface of the pliant flaps 22. The male catches 2 are shaped to keep the pressure onto the belly of the person 40 at a low level and evenly distributed while the soft container 1 is worn by the person 40. The male catches 2 fit into correspondingly shaped female catches 13 positioned on opposing sides of the stiff container 18. It is noted that only the front female catch 13 is visible in FIG. 1. A second female catch 13 has to be considered on the corresponding location of the opposing side of the stiff container 18. The male catches 2 are easily interlocked with the female catches 13 and thus provide fixating features that provide for an easily established initial interlocking between the containers 1, 18.

According to FIG. 1, the stiff container 18 has a top lid 21 that contacts the stiff container 18 along a circumferential edge 19. In the preferred embodiment, the circumferential edge 19 is at least partially occupied by a zipper that secures the top lid 21 in a closed position. A handgrip 11 may also be attached on the top of the stiff container 18. The handgrip 11 has preferably a rubber grip. The handgrip 11 is sufficiently soft to give room for opening the top lid 21.

Figure 4:
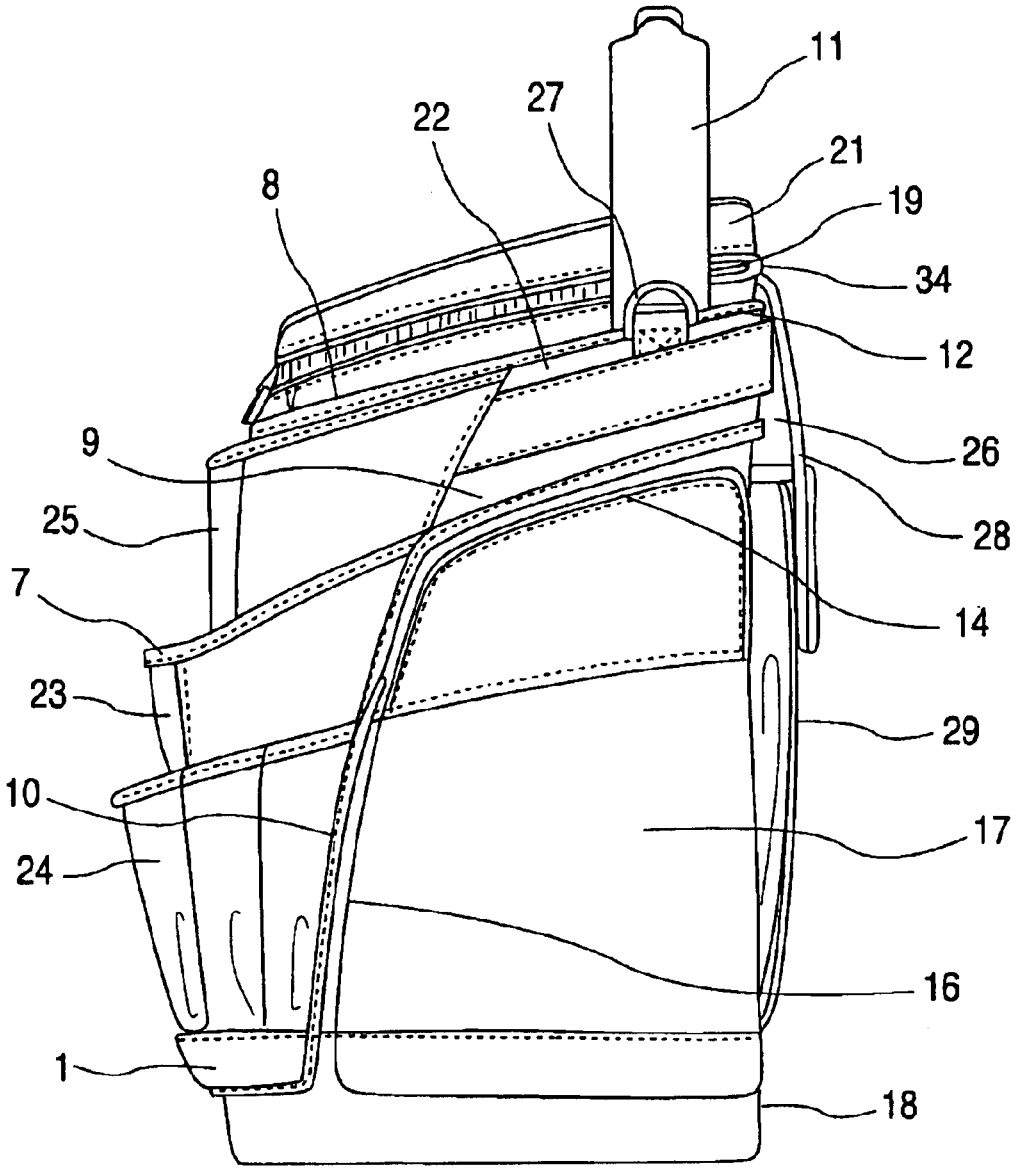
FIG. 4 shows a side view of the assembled containers.
Figure 5:
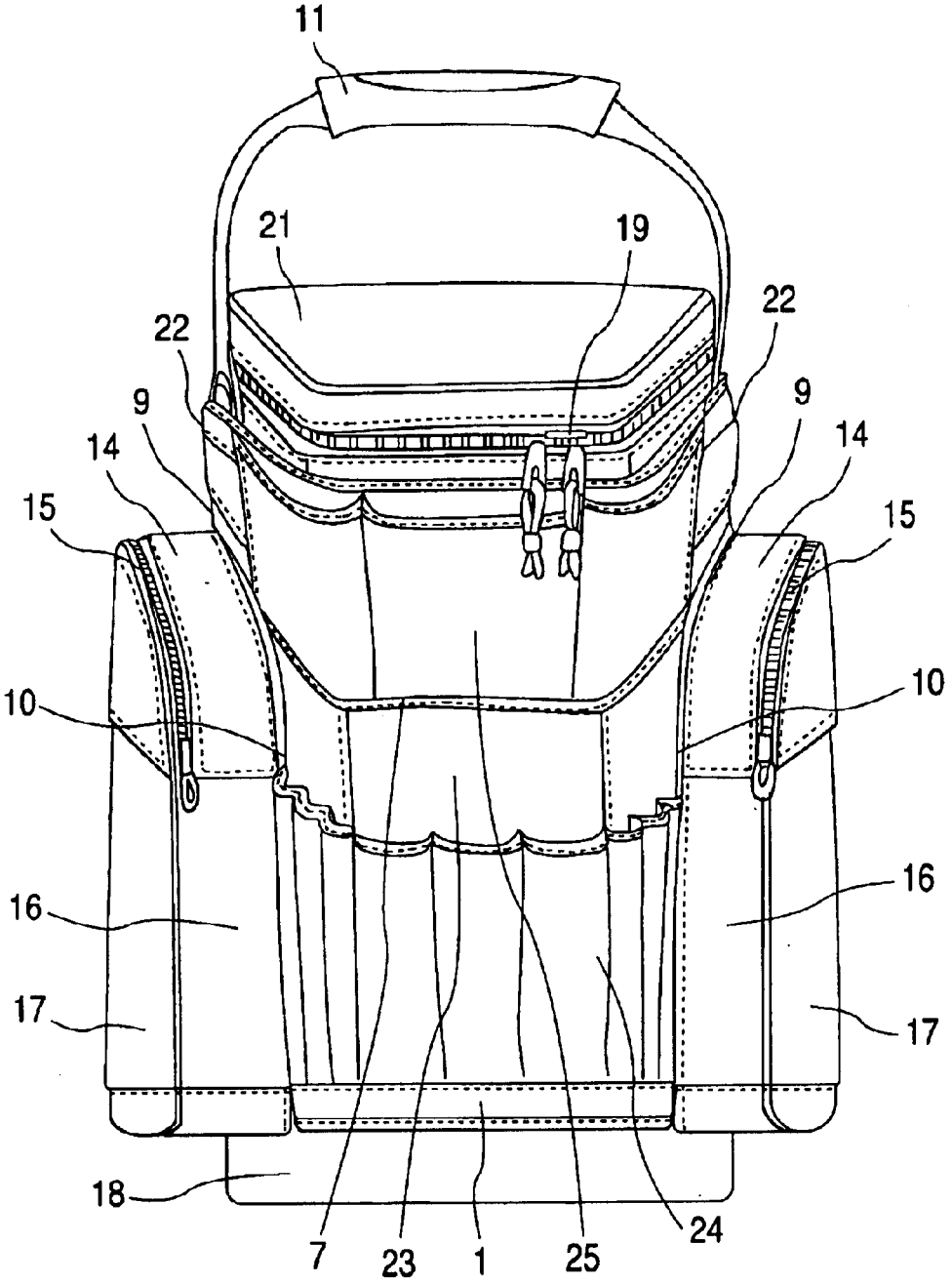
FIG. 5 shows a front view of the assembled containers.

The stiff container 18 has shoulder pockets 17 laterally extending from two opposing vertical sides of the stiff container 18 (see also FIG. 5). The shoulder pockets 17 operate with their flap shoulder 14 and their bag shoulder 16 also as positioning features that assist in keeping the soft container 1 in a fixed position while attached to the stiff container 18. In assembled configuration, where the male catches 2 interlock with their corresponding female catches 13 and gravity forces the soft container 1 downwards, the flap edges 9 cling on the flap shoulders 14 and the bag edges 10 cling on the bag shoulders 16 (see FIGS. 2, 4, 5). The shoulders 14, 16 are positioning shoulders which may be provided by any structure laterally protruding from said stiff container 18.

Adjacent to the female catches 13 are on both sides of the stiff container 18 secondary lugs 12. The secondary lugs 12 are positioned such that the strap buckles 6 may be simultaneously snapped on the primary lugs 27 and the secondary lugs 12. As a result, the shoulder strap 3 may be directly attached and secured to both containers 1, 18 (see also FIG. 2).

Figure 2:
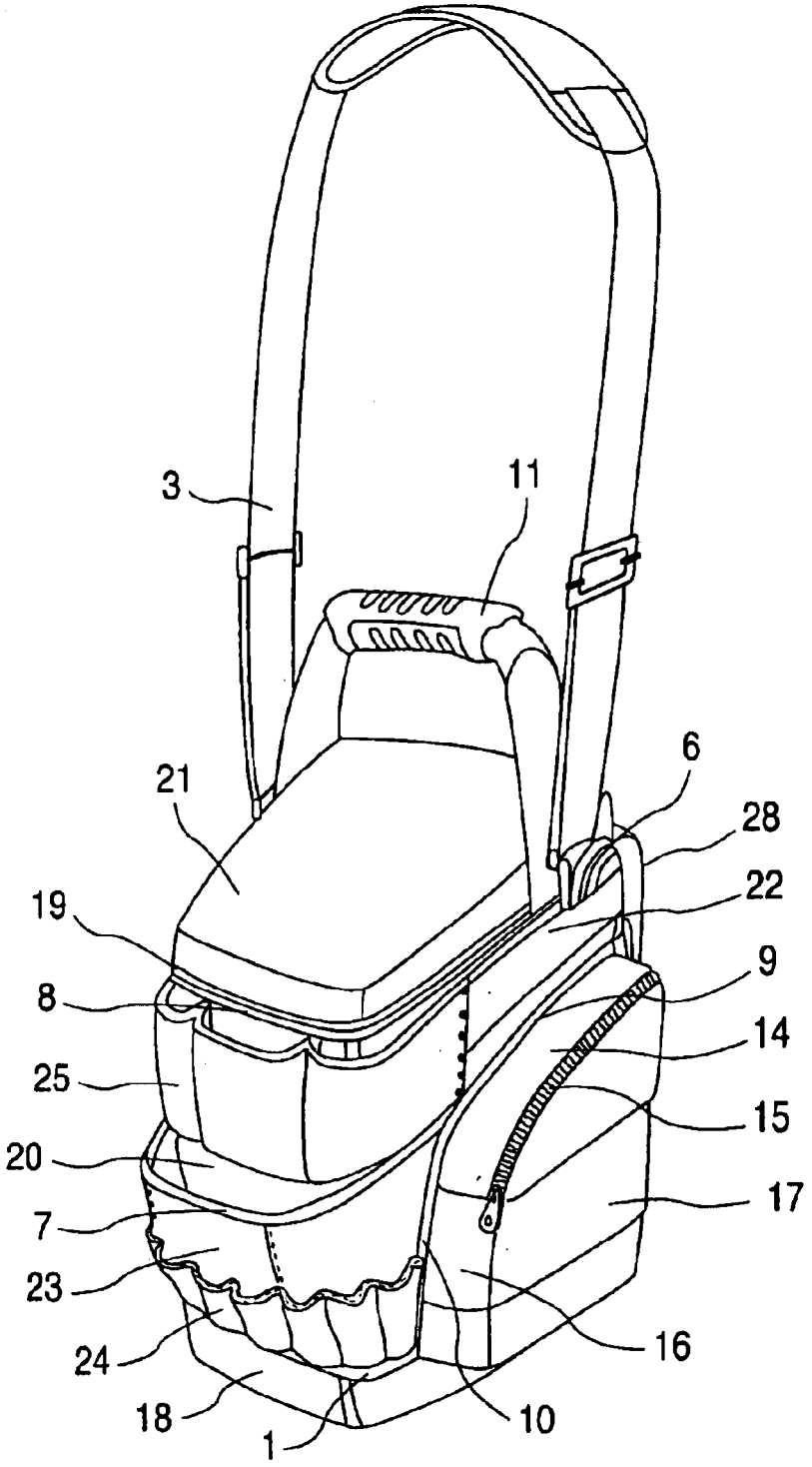
FIG. 2 shows a three dimensional view of the assembled containers.

According to FIG. 2 and the preferred embodiment of the invention, the soft container 1 is attached with and positioned on the stiff container 18 where the male catches 2 interlock with the corresponding female catches 13 and where the edges 9, 10 rest on the corresponding shoulders 14, 16. In that case, the upper edge 8 is essentially parallel and offset to the circumferential edge 19 such that the zipper attached along the circumferential edge 19 can be freely accessed. The soft container remains also in a sufficient distance from a surface on which the stiff container 18 may be standing on. In the assembled configuration, the pliant flaps 22 and the pliant body 20 are also in a clinging fit with the outside of the stiff container 18. The pocket zips 15 (see also FIG. 5) remain free and provide access to the interior of the shoulder pockets 17.

In order to prevent the belt 5 from loosely hanging away from the assembled containers 1, 18, the stiff container 18 has a belt pocket 28 (see also FIG. 4). After the soft container 1 has been fixated on the stiff container 18, the belt 5 may be folded into the belt pocket 28. The belt pocket 28 may provide at least one lateral opening through which the belt 5 may be guided without wrinkling into the belt pocket 28. Referring to FIG. 4, the belt pocket 28 may be recessed from a smooth face 29 such that the assembled containers 1, 18 or the stiff container 18 alone can be carried at the side of a person with the smooth face 29 being in smooth contact with a body portion of the carrying person. It is clear to one skilled in the art that the scope of the present invention is not limited to any particular configuration and/or number of storage structures and/or pockets of the container 18. In the preferred embodiment, the containers 1, 18 are made from materials including Velcro. The stiffness of the stiff container 18 is provided by stiff structures embedded between layers of Velcro.

While this invention has been described with reference to the specific embodiments disclosed herein, it is not confined to the details set forth and the patent is intended to include modifications and changes, which may come within and extend from the following claims:

What is claimed is

1. A modular container comprising:

a. a tool belt assembly having a tailored contour to provide a clinging fit to a body contour of a person and configured to be worn around the hip area of the person, the tool belt assembly comprising:
   i. a primary fixating feature; and
   ii. a positioning edge;

b. a stiff container comprising:
   i. a secondary fixating feature corresponding to the primary fixating feature, the secondary fixating feature providing an interlocking with the tool belt assembly;
   ii. a positioning shoulder corresponding to the positioning edge such that the tool belt assembly is fixated in an assembly position while interlocking via the primary and secondary fixating features; and
   iii. a stiffness for receiving and supporting the tool belt assembly while the tool belt assembly is being fixated in the assembly position; and c. a shoulder strap detachably affixed to the modular container.

2. The modular container of claim 1, wherein the stiff container is further shaped to stand unsupported.

3. The modular container of claim 1, wherein the stiff container is further shaped to stand unsupported while the tool belt assembly is assembled with the stiff container.

4. The modular container of claim 1, wherein the stiff container further comprises a handgrip.

5. The modular container of claim 1, further comprising:

a primary lug attached on the tool belt assembly;

a secondary lug attached on the stiff container; wherein the lugs are attached on positions such that in the assembly position the primary lug and the secondary lug are simultaneously accessible by a strap buckle of the shoulder strap.

6. A modular personal container comprising:

a. a tool belt assembly having a tailored contour to provide a clinging fit to a body contour of a person and configured to be worn around the hip area of the person, the tool belt assembly comprising:
   i. a primary fixating feature; and
   ii. a positioning edge;

b. a stiff container comprising:
   i. a secondary fixating feature corresponding to the primary fixating feature, the secondary fixating feature providing an interlocking with the tool belt assembly;
   ii. a positioning shoulder corresponding to the positioning edge such that the tool belt assembly is fixated in an assembly position while interlocking via the primary and secondary fixating features; and
   iii. a stiffness for receiving and supporting the tool belt assembly while the tool belt assembly is being fixated in the assembly position; and wherein the positioning shoulder is provided by a lateral protrusion laterally protruding from the stiff container.

7. The modular container of claim 6, wherein the lateral protrusion is a pocket.

8. A modular personal container comprising:

a. a tool belt assembly having a tailored contour to provide a clinging fit to a body contour of a person and configured to be worn around the hip area of the person, the tool belt assembly comprising:
   i. a primary fixating feature; and
   ii. a positioning edge;

b. a stiff container comprising:
   i. a secondary fixating feature corresponding to the primary fixating feature, the secondary fixating feature providing an interlocking with the tool belt assembly;
   ii. a positioning shoulder corresponding to the positioning edge such that the tool belt assembly is fixated in an assembly position while interlocking via the fixating features; and
   iii. a stiffness for receiving and supporting the tool belt assembly while the tool belt assembly is being fixated in the assembly position; and wherein the stiff container further comprises a belt pocket for receiving and storing a belt of the tool belt assembly.

9. The modular container of claim 8, and wherein the belt pocket is recessed from a smooth face of said stiff container.

10. A modular personal container comprising:

a. a tool belt assembly having a tailored contour to provide a clinging fit to a body contour of a person and configured to be worn around the hip area of the person, the tool belt assembly comprising:
   i. a primary fixating feature; and
   ii. a positioning edge;

b. a stiff container comprising:
   i. a secondary fixating feature corresponding to the primary fixating feature, the secondary fixating feature providing an interlocking with the tool belt assembly;
   ii. a positioning shoulder corresponding to the positioning edge such that the tool belt assembly is fixated in an assembly position while interlocking via the primary and secondary fixating features; and
   iii. a stiffness for receiving and supporting the tool belt assembly while the tool belt assembly is being fixated in the assembly position; and wherein the stiff container further comprises a top lid that contacts a main body of the stiff container along a contacting circumference while the top lid is closed.

11. The modular container of claim 10, and wherein the contacting circumference is shaped in correspondence with an upper tailor line of the tool belt assembly such that at least a first portion of the contacting circumference is in a continuous distance to at least a second portion of the tailor line.

12. The modular container of claim 11, and wherein the first portion of said contacting circumference is occupied by a zipper for securing the top lid in a closed position and wherein the continuous distance is selected to provide access to the zipper.

* * * * *